US006332295B1

(12) United States Patent
Spielhoff

(10) Patent No.: US 6,332,295 B1
(45) Date of Patent: Dec. 25, 2001

(54) OFFICE PARTITION WALL ARRANGEMENT

(75) Inventor: Peter Spielhoff, Dortmund (DE)

(73) Assignee: Bosse Design Gesellschaft für Innovative Office Interiors mbH & Co. KG, Höxter (DE)

( * ) Notice: Subject to any disclaimer, the term of this patent is extended or adjusted under 35 U.S.C. 154(b) by 0 days.

(21) Appl. No.: 09/431,778

(22) Filed: Nov. 2, 1999

(30) Foreign Application Priority Data

Nov. 3, 1998 (DE) ..... 298 19 593 U

(51) Int. Cl.[7] ..... E04H 1/12

(52) U.S. Cl. ..... 52/239; 52/238.1; 52/241; 52/36.5; 52/36.6

(58) Field of Search ..... 52/238.1, 241, 52/36.5, 36.6

(56) References Cited

U.S. PATENT DOCUMENTS

| | | | | |
|---|---|---|---|---|
| 3,371,454 | | 3/1968 | Anderson . | |
| 3,537,217 | | 11/1970 | Lickliter . | |
| 3,733,755 | | 5/1973 | Butler . | |
| 4,631,881 | | 12/1986 | Charman . | |
| 4,655,019 | * | 4/1987 | Reje | 52/475 |
| 5,005,325 | * | 4/1991 | Dull et al. | 52/126.4 |
| 5,214,890 | | 6/1993 | Levitan et al. . | |
| 5,214,893 | * | 6/1993 | Clement | 52/223.6 |
| 5,433,046 | | 7/1995 | MacQuarrie et al. . | |
| 6,115,977 | * | 9/2000 | Hornberger et al. | 52/238.1 |
| 6,158,179 | * | 12/2000 | Ackerly et al. | 52/220.7 |

FOREIGN PATENT DOCUMENTS 2 323 027 9/1998 (GB) .

* cited by examiner

*Primary Examiner*—Beth A. Stephan
*Assistant Examiner*—Christy M. Syres
(74) *Attorney, Agent, or Firm*—Browdy and Neimark

(57) ABSTRACT

A partition wall arrangement, in particular for offices, comprises at least a support section for the vertical support of the partition wall arrangement, the support section having a longitudinal direction, and at least one arrest line, which extends in the longitudinal direction and has snap-in holes for the locking engagement of objects to be joined thereto.

10 Claims, 11 Drawing Sheets

OFFICE PARTITION WALL ARRANGEMENT

BACKGROUND OF THE INVENTION

1. Field of the Invention

The invention relates to a partition wall arrangement, in particular for offices.

2. Background Art

In modern office buildings, the members of the staff very often do not have rooms of their own separated by solid walls. Rather, so-called open plan offices are the rule, where lots of persons work simultaneously. In order to ensure individual privacy and concentration, partition wall systems have become known, consisting of a supporting structure and partition wall arrangements fixed therein, which permit to surround places of work by walls of a height generally not reaching from floor to ceiling. Due to frequent changes in the staff and due to the permanently changing requirements in terms of electronic infrastructure, frequent displacement of the walls or modification of the wiring for illumination, computers, telephones etc. is necessary. These reconditioning measures are time-consuming and costly, in particular in cases when the electric wall infrastructure is to disappear completely.

SUMMARY OF THE INVENTION

It is an object of the invention to embody a partition wall arrangement which is easy to manufacture and to assemble and disassemble.

This object is attained by a partition wall arrangement, in particular for offices, comprising at least a support section for the vertical support of the partition wall arrangement, the support section having a longitudinal direction, and at least one arrest line, which extends in the longitudinal direction and has snap-in holes for the locking engagement of objects to be joined thereto. The gist of the invention resides in embodying a support section which further elements may snap-engage with.

Additional features and details will become apparent from the description of an exemplary embodiment, taken in conjunction with the drawing.

DESCRIPTION OF THE PREFERRED EMBODIMENT

The individual components of the embodiment according to the invention are described with reference to FIGS. 1 to 15. Then the cooperation of the individual components is described, referring to FIGS. 16 to 24.

Figure 1:
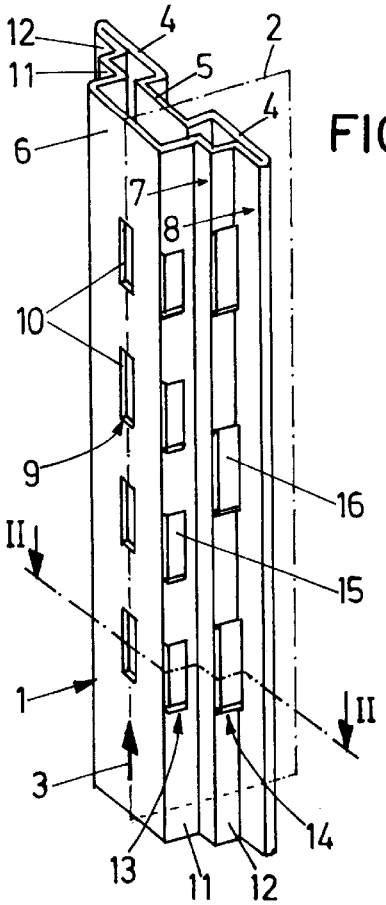
FIG. 1 is a plan view of a support section.
Figure 2:
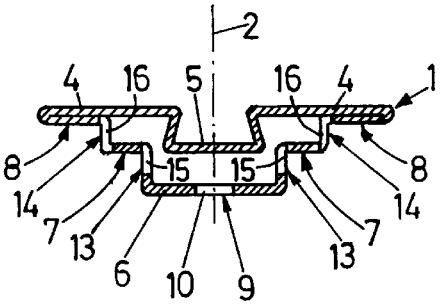
FIG. 2 is a cross-sectional view of the support section according to FIG. 1 on the section line II—II of FIG. 1.

A hollow support son 1 seen in FIGS. 1 and 2 has a design in mirror symmetry to a central longitudinal plane 2, extending in a longitudinal direction 3. The support section 1 comprises an outer support leg 4, which is interrupted by a dove-tailed outer groove 5. On the side opposite to the outer support leg 4, an inner support leg 6 is provided parallel thereto, which, in symmetry to the central longitudinal plane 2, is joined to the outer support leg 4 via two steps 7, 8. In the longitudinal direction 3, a central arrest line 9 with central snap-in holes 10 is provided in the inner support leg 6. The steps 7, 8 have fronts 11, 12, which are parallel to the plane 2 and which are provided with forward arrest lines 13 and rearward arrest lines 14 parallel and in mirror symmetry to the central longitudinal plane 2, the forward and rearward arrest lines 13, 14 having forward snap-in holes 15 and rearward snap-in holes 16. The support section 1 is a hollow section made of metal, typically having a length of up to 2.50 m.

Figure 3:
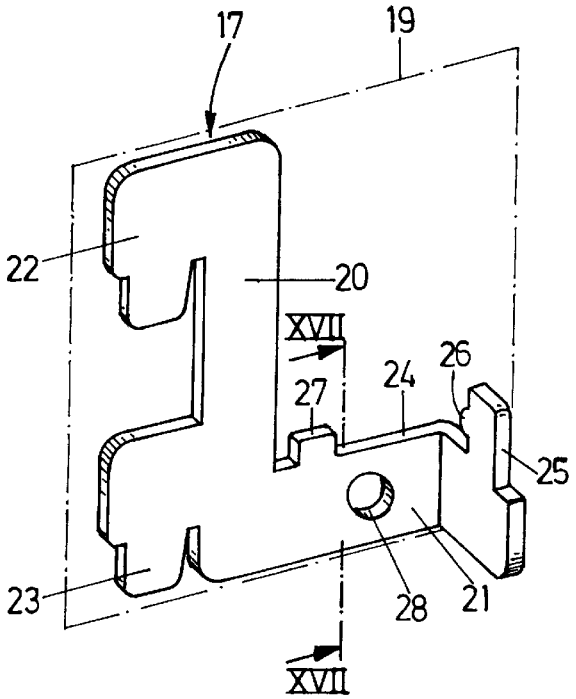
FIG. 3 is a plan view of a mounting hook.

A mounting hook 17 is illustrated in FIG. 3. Another mounting hook 18, which is chiral thereto, is provided by reflection of the mounting hook 17 seen in FIG. 3 on the mirror plane 19. The mounting hook 18 is illustrated in sections in FIG. 17. The mounting hook 17 comprises a hook body 20 of vertical extension in FIG. 3 and a vertical hook arm 21, the two being integral. Two locking projections 22, 23 are provided one above the other on the hook body 20. The end of the hook arm 21 is angled by 90° to the right related to the viewing direction XVII in FIG. 3, a projection 25 with a clamping nose 26 that projects to the left in the viewing direction XVII in FIG. 3 being provided on the upper side 24 of the arm. An insertion stop 27 is provided on the upper side 24 of the arm in vicinity to the hook body 20. A hole 28 extends substantially perpendicular to the viewing direction XVII in FIG. 3 through the hook arm 21. As for the mounting hook 18, corresponding parts are denoted by the same reference numerals as for the mounting hook 17 (the description of which is referred to), however provided with a prime.

Figure 4:
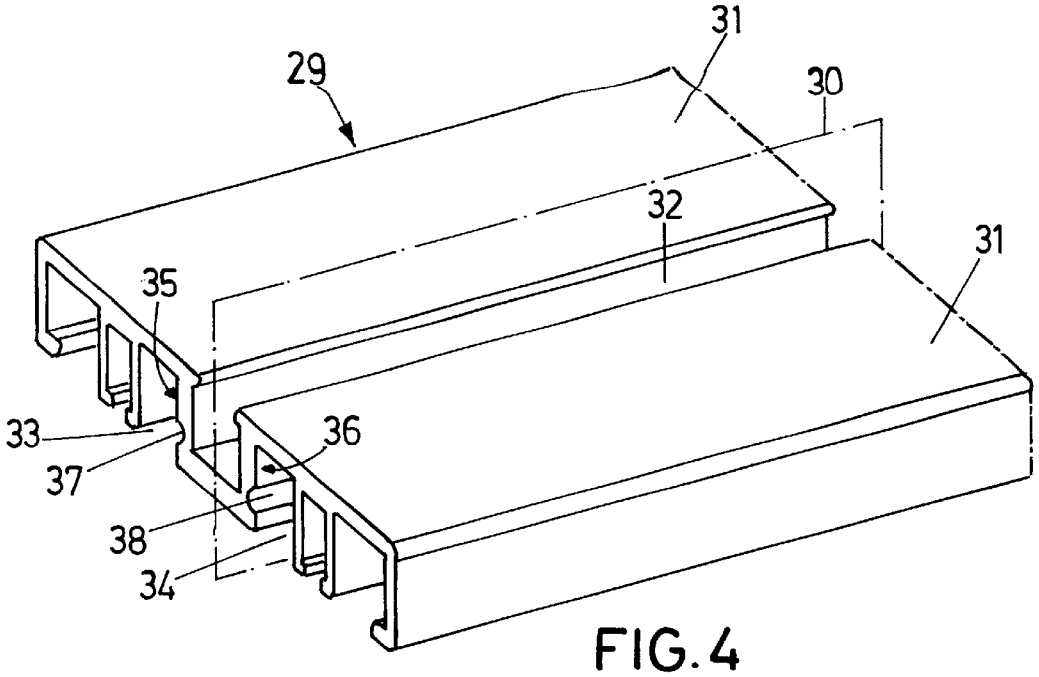
FIG. 4 is a plan view of a pane supporting board.

A pane supporting board 29 seen in FIG. 4 is designed as a section which mirror symmetrical to a central longitudinal plane 30. The pane supporting board 29 has a bracket 31 on its upper side, the bracket 31 being interrupted by a pane holding groove 32. On both sides of the pane holding groove 32, provision is made for insertion channels 33, 34, which are open towards the underside of the board 29, clamping flutes 37, 38 of lengthwise extension being provided on the channel walls 35 and 36 which are turned towards the panel holding groove 32.

Figure 5:
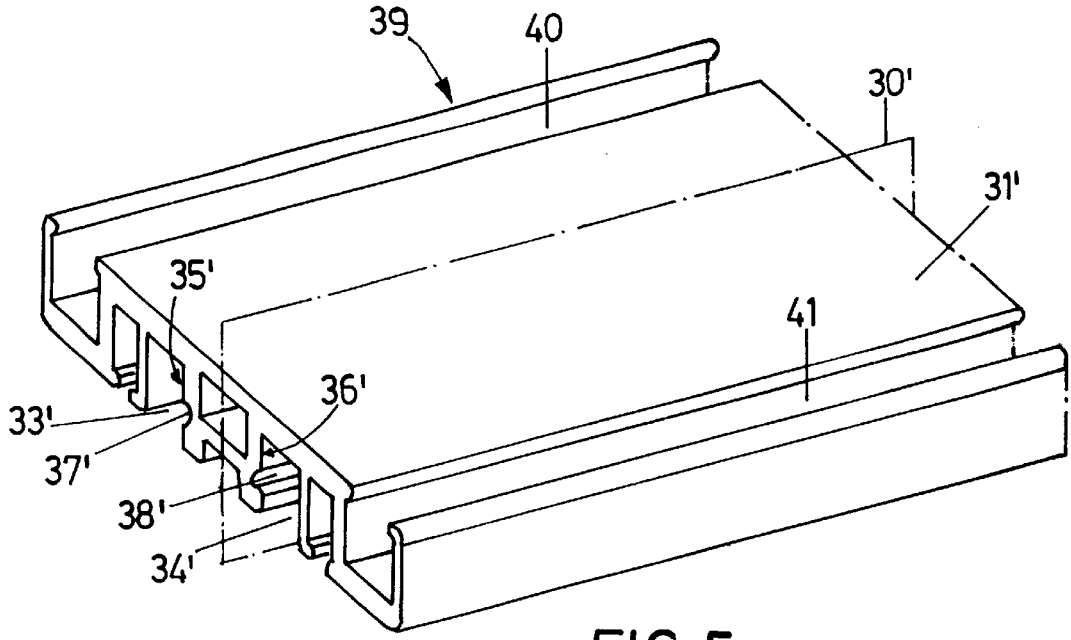
FIG. 5 is a plan view of a double pane supporting board.

FIG. 5 illustrates a double pane supporting board 39. It has two pane holding grooves 40, 41. As for the rest, the board 39 has substantially the same design as the board 29, which is why the same reference numerals are used as for the board 29, however provided with a prime.

Figure 6:
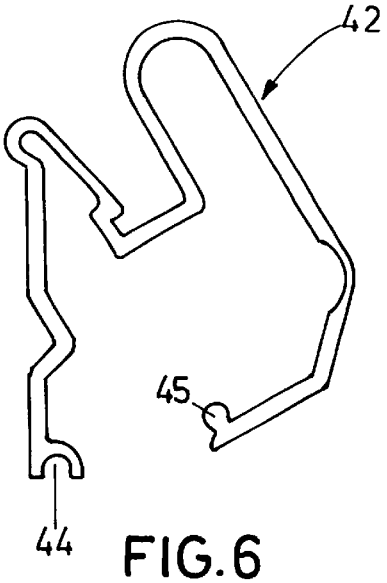
FIG. 6 is a lateral view of a fixing clamp in an opened position.
Figure 7:
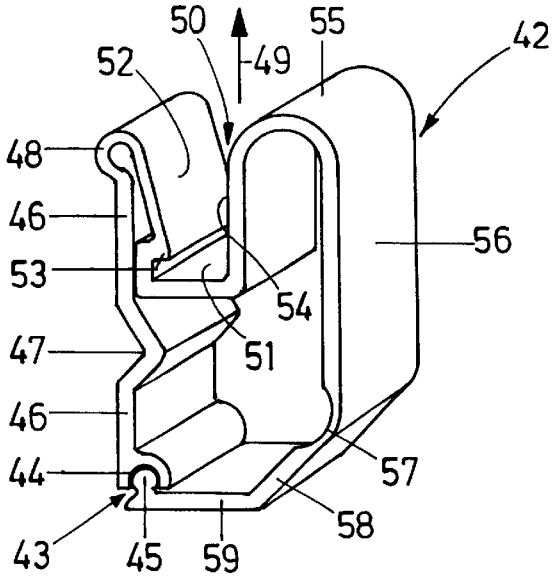
FIG. 7 is a plan view of the fixing clamp of FIG. 6 in a closed position.

FIGS. 6 and 7 illustrate a fixing clamp 42. The fixing clamp 42 is formed as an integral section and can be opened and closed in the vicinity of a snap 43. The snap 43 consists of a groove 44 and a snap-in projection 45 to be engaged therewith. The following is a description of the structure of the fixing clamp 42 with reference to FIG. 7 where the fixing clamp 42 is illustrated with the snap 43 closed, starting from the groove 44 and clockwise following the contour. The groove 44 is followed by a bearing leg 46 of substantially plain extension, which is interrupted by a wedge-shaped groove 47 extending into the inside of the fixing clamp 42. On the end of the bearing leg 46 that is turned away from the groove 44, provision is made for a support projection 48 projecting from the leg 46. An insertion channel 50, which is open in a direction of insertion 49, is provided in the neighborhood, the direction of insertion 49 extending substantially parallel to the bearing leg 46. The insertion channel 50 comprises a wall 52, which tapers toward the bottom 51 of the channel 50 and has a locking projection 53, the wall 52 being joined to the supporting projection 48. The bearing leg 46, the supporting projection 48 and the wall 52 constitute a locking arm unit. A wall 54 is provided opposite the wall 52, extending substantially parallel to the direction of insertion 49. Subsequent to the wall 54, provision is made for a supporting arc 55, which projects relative to the supporting projection 48 in the direction of insertion 49. The arc 55 is followed by a fixing leg 56, which is substantially parallel to the bearing leg 46. Joined to the fixing leg 56 is a hinge 57, which is formed by reduced wall thickness as compared to the rest of the fixing clamp 42 and which is connected to a hinge arm 58; the hinge arm 58 passes into a transverse bearing leg 59, which is substantially perpendicular to the direction of insertion 49 and is provided with the snap-in projection 45 on its free end. The fixing clamp 42 is made from plastic material.

Figure 8:
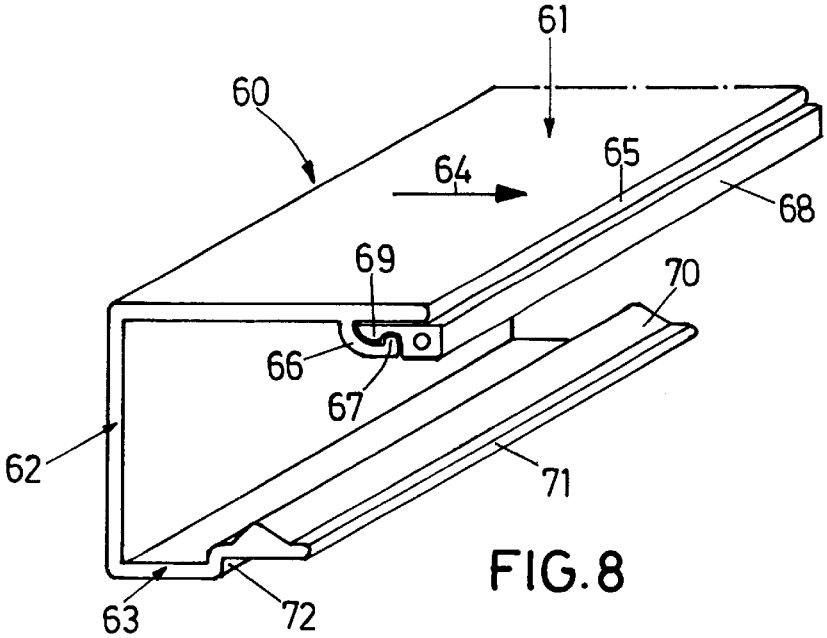
FIG. 8 is a plan view of a capping.

A capping 60 is described in the following with reference to FIG. 8. The capping 60 is a U-shaped section, having an inner leg 61, a base 62 subsequent thereto, and a fixing leg 63 subsequent to the base 62. The capping 60 is a rectangular section unilaterally open in a direction of insertion 64. In the vicinity of the free end 65 of the inner leg 61, provision is made for a hook web 66, which projects towards the inside of the capping 60 and on the end of which is provided a rear recess 67. By means of an anchoring web 69, a sealing lip 68 is held under tension in the direction of insertion 64 between the hook web 66 and the inner leg 61, having positive fit; the anchoring web 69 bears under tension against the rear recess 67 in the direction of insertion 64. The sealing lip 68 projects over the end 65 in the direction of insertion 64. The fixing leg 63 has a wedged rib 70, which extends into the inside of the capping 60 and the foredge 71 of which is displaced relative to the fixing leg 63, forming a shoulder 72.

Figure 9:
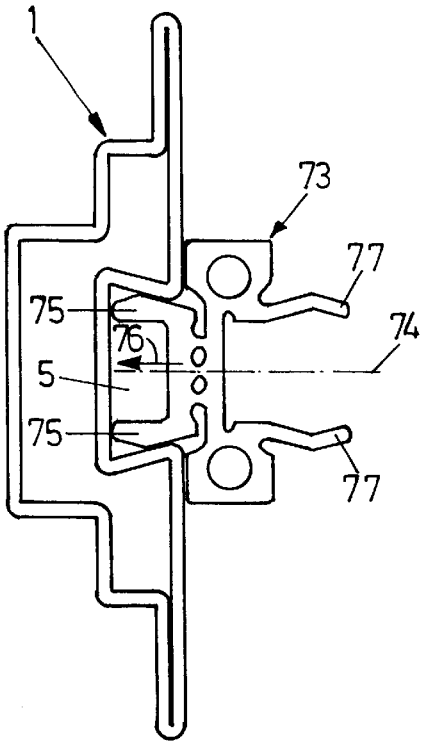
FIG. 9 is a lateral view of a spacer in locking engagement with the support section of FIG. 2.

A spacer 73 is described with reference to FIG. 9, which is symmetrical relative to a central longitudinal plane 74, having two jaws 75, which expand outwardly and extend substantially in a direction of insertion 76 which is parallel to the central longitudinal plane 74. The spacer 73 further comprises two spring arms 77 which are directed against the direction of insertion 76. The spacer 73 is made of flexible material, in particular of flexible plastic material.

Figure 10:
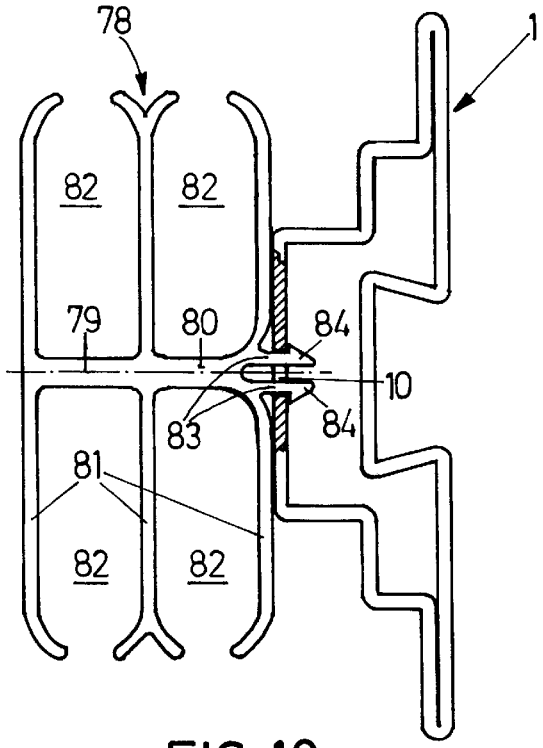
FIG. 10 is a lateral view of a cable clamp in locking engagement with the support section of FIG. 2.

As seen in FIG. 10, a cable clamp 78 is symmetrical to a central longitudinal plane 79. Provided on a support body 80 on both sides of the central longitudinal plane 79 are three fixing aims 81, which are substantially perpendicular relative thereto and the ends of which are formed such that they almost entirely enclose cable housing portions 82. Cables may be inserted through the remaining openings of the cable housing portions 82 into the cable clamp 78 where they are clamped. Provided on the right end, in FIG. 10, of the support body 80 on both sides of the central longitudinal plane 79 are two locking webs 73, which are substantially parallel thereto and on the ends of which locking projections 84 are provided, which project in a direction away from the central longitudinal plane 79. The cable clamp 78 is manufactured from flexible plastic material, because the fixing arms 81 for the insertion of the cables must be springy.

Figure 11:
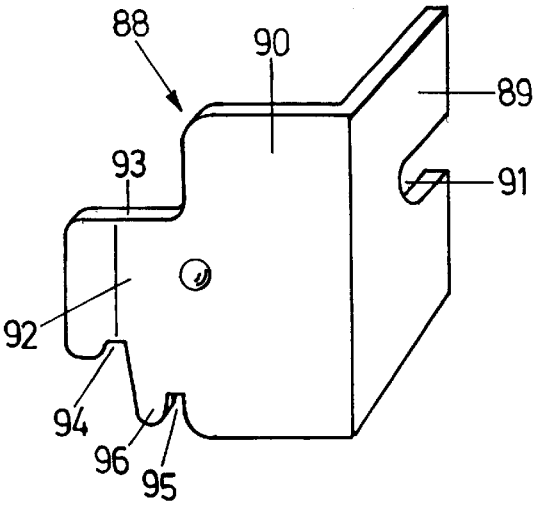
FIG. 11 is a plan view of a lower panel mount.
Figure 12:
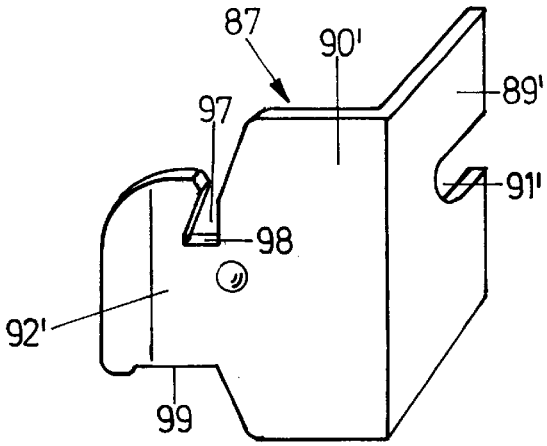
FIG. 12 is a plan view of an upper panel mount.
Figure 13:
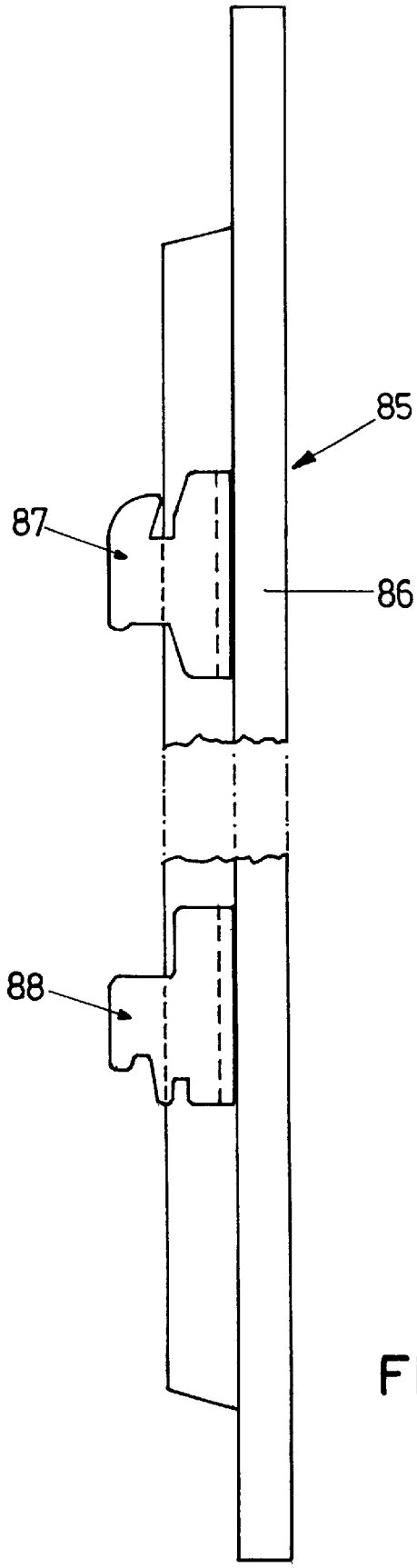
FIG. 13 is a lateral view of a hang-up panel comprising the panel mounts of FIGS. 11 and 12.

A hang-up panel 85 according to FIG. 13 comprises, in the vicinity of its two lateral fronts 86, an upper panel mount 87 and a lower panel mount 88, which are described in detail in the following with reference to FIGS. 11 and 12.

The lower panel mount 88 has a cross-section in the shape of an L, comprising a fixing leg 89 and a base leg 90, which is substantially perpendicular thereto. Provided in the fixing leg is an oblong fixing hole 91, which is open on one side and through which the lower panel mount 88 is connected to the hang-up panel 85 by means of a screw of other fasteners. On its free end, the base leg 90 has a prolongation 92 with a stop edge 93, the upper edge of which stands back relative to the base leg 90 in FIG. 11. Provided from the outside to the inside on the lower edge of the prolongation 92 are a first seat 94 and a final seat 95 which are separated from each other by a projection 96.

The following is a description of the upper panel mount 87, parts that are identical with parts of the lower panel mount 88 being denoted by the same reference numeral provided with a prime. An angle groove 97, which expands towards its bottom 98, is provided on the prolongation 92' on the upper edge in FIG. 12. A stop edge 99 is provided on the lower edge of the prolongation 92.

Figure 14:
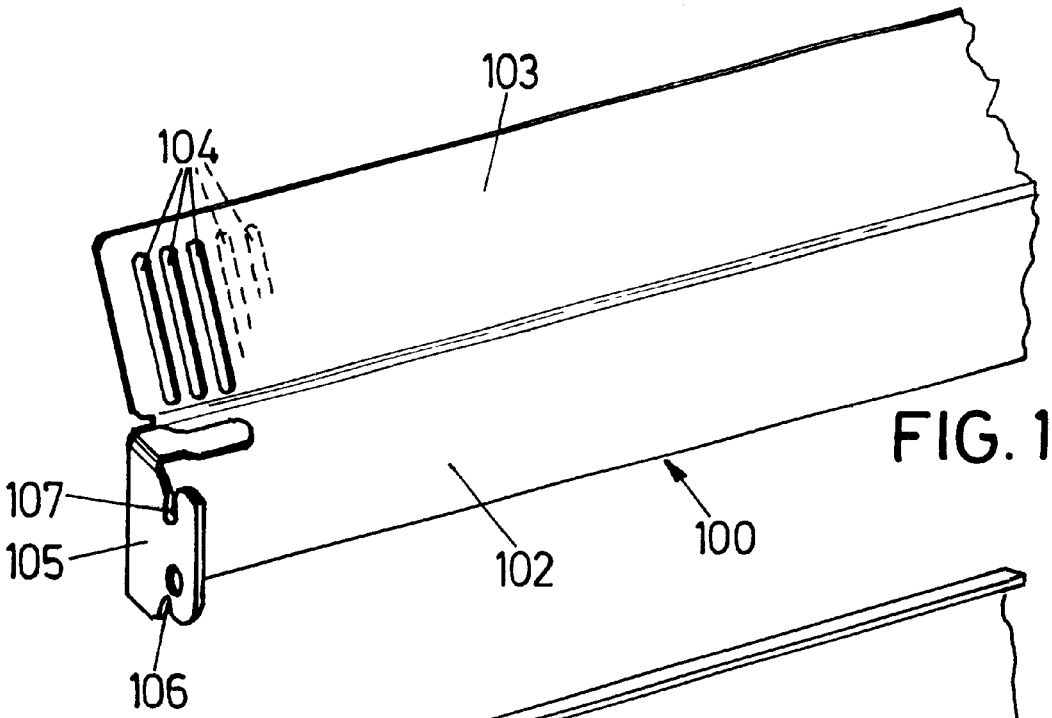
FIG. 14 is a plan view of a ventilation facing board.
Figure 15:
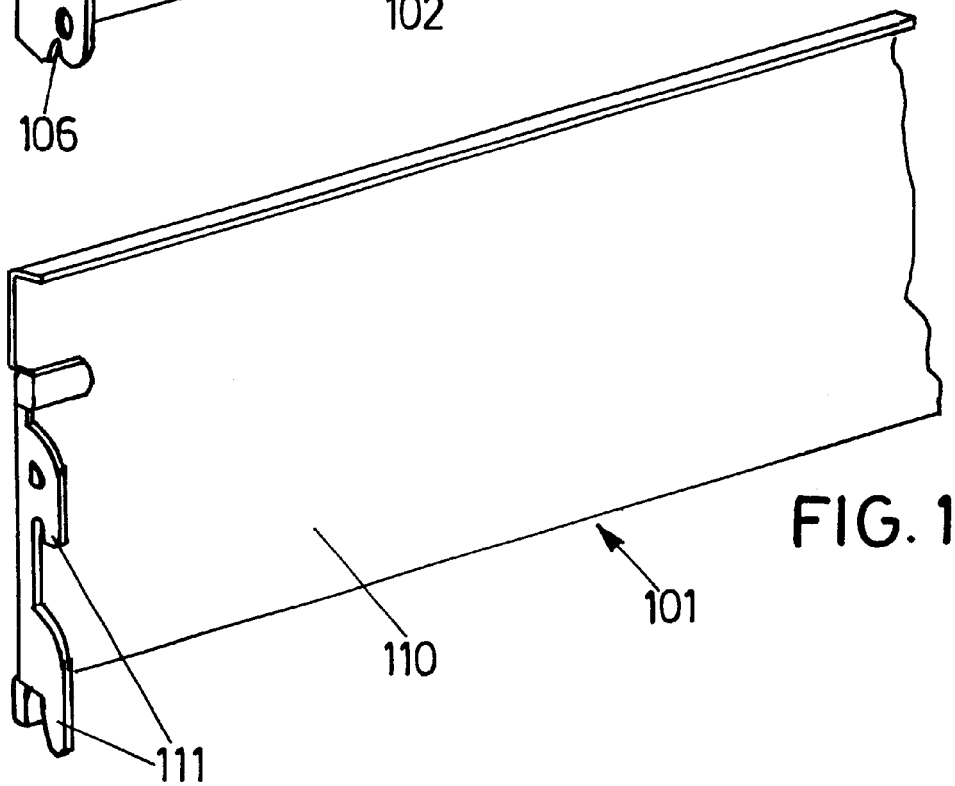
FIG. 15 is a plan view of another facing board.

FIGS. 14 and 15 illustrate a ventilation facing board 100 and a facing board 101, respectively. The ventilation facing board 100 has a base board 102 as well as a ventilation board 103 which is integral therewith and angled relative thereto and which has vent slits 104. Locking arms 105 are provided on the ends on both sides of the base board 102, having a snap-in seat 106, which is open downwards in FIG. 14, and a snap-in slit 107, which is open upwards and illustrated in detail in FIGS. 22, 23 and 24. The snap-in slit 107 comprises an insertion slit 108, which runs substantially parallel to the ventilation board 103, and a base slit 109.

In the case of the facing board 101 according to FIG. 15, two locking projections 11, which run downwards in FIG. 15, are provided on the ends on both sides.

Assembly and cooperation of the parts so far described are explained below, taken in conjunction with FIGS. 16 to 24 and FIGS. 9 and 10.

Figure 16:
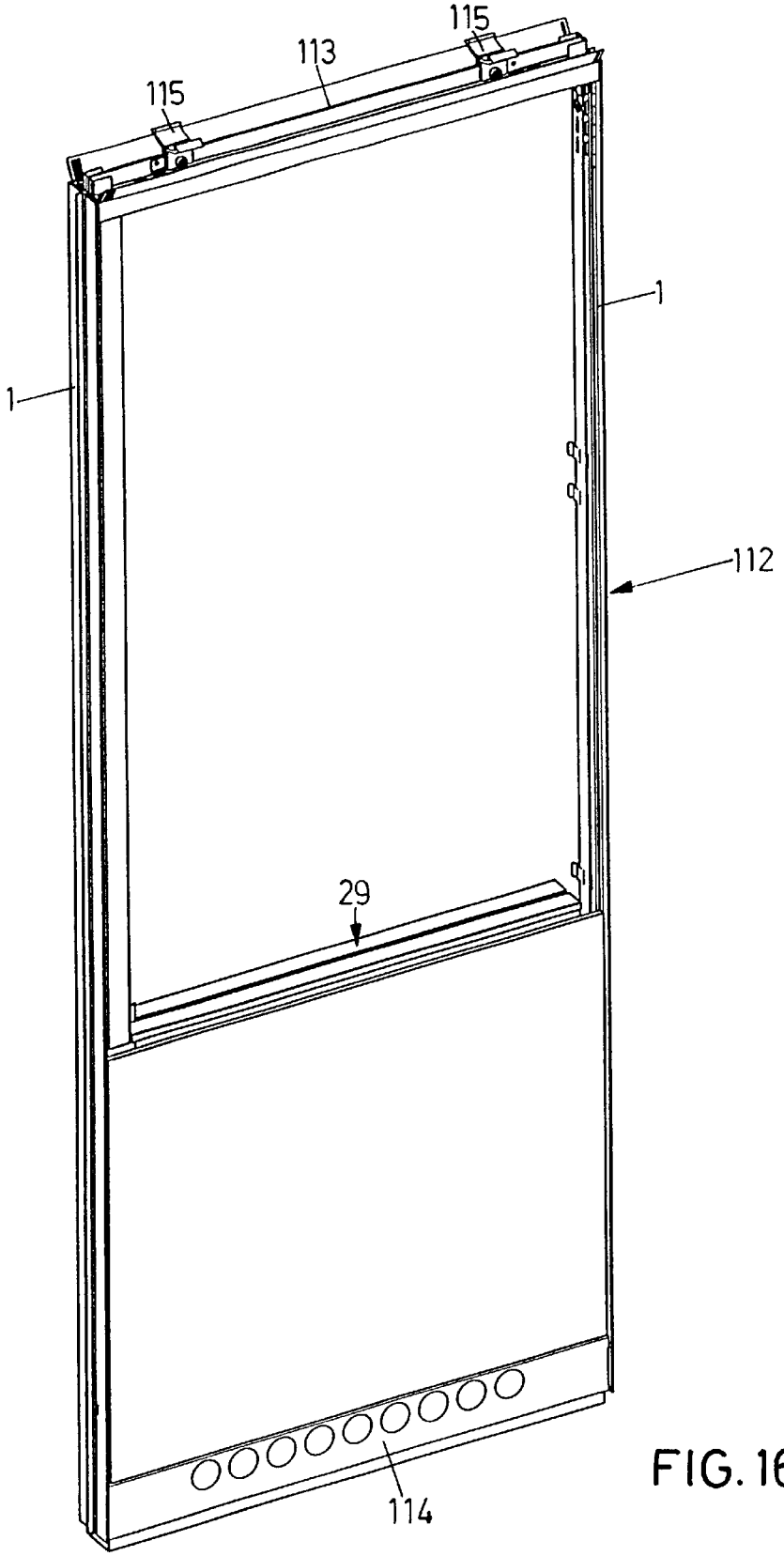
FIG. 16 is a partition wall arrangement according to the invention in a position of partial assembly.

FIG. 16 illustrates a partially assembled partition wall arrangement 112 of a 20 partition wall system. It consists of two lateral support sections 1 of vertical extension in FIG. 16, which are disposed in mirror symmetry to each other. The support sections 1 are joined to each other by a ceiling board 113 at their upper end and by a skirting board 114 at their lower end so that a frame is produced which is substantially self-supporting. The skirting board 114 is supported on the ground in for example office space. By means of fixing clamps 115, the ceiling board 113 is joined to a conventional supporting structure (not seen in FIG. 16) so that the partition wall arrangement is stable.

Figure 17:
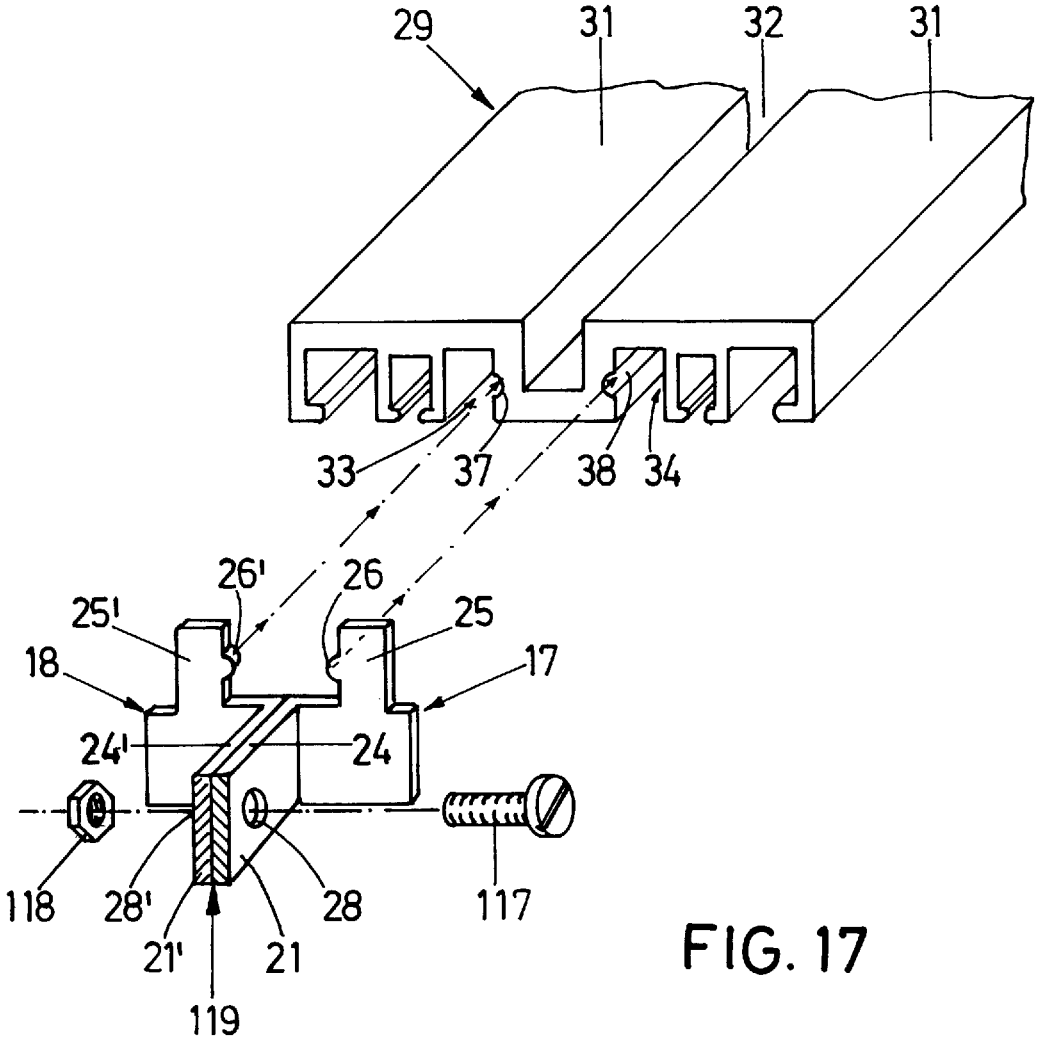
FIG. 17 is a plan view of a hook unit having mounting hooks cut on the line XVII—XVII of FIG. 3 and a plan view of the pane supporting board of FIG. 4.

The assembly of a glass pane 116 or a pane of some other material is described below with reference to FIGS. 17 and 18. For each support section 1, a mounting hook 17 and a mounting hook 18 are joined to each other by a screw 117, which is led through the holes 28 and 28', and by a nut 118 placed thereon, loosely forming a hook unit 119. One hook unit 119 at a time is hung up in a support section 1 to be level with the central arrest line 9, the locking projections 22, 23 being hung up in the support section 1 by adjacent central snap-in holes 10. The pane supporting board 29 is placed on the opposed hook units 119, the projections 25, 25' being inserted in the insertion channels 33, 34 from above or laterally. Then the screws 117 are tightened on both sides, as a result of which the clamping noses 26, 26' engage positively with the clamping flutes 37 and 38 related to the vertical direction in FIG. 16, clamping the pane supporting board 29. In case two parallel glass panes are to be mounted, the double pane supporting board 39 is employed, its connection by the hook units 119 taking place in the same way. The glass pane 116 is inserted in the pane holding groove 32.

Figure 18:
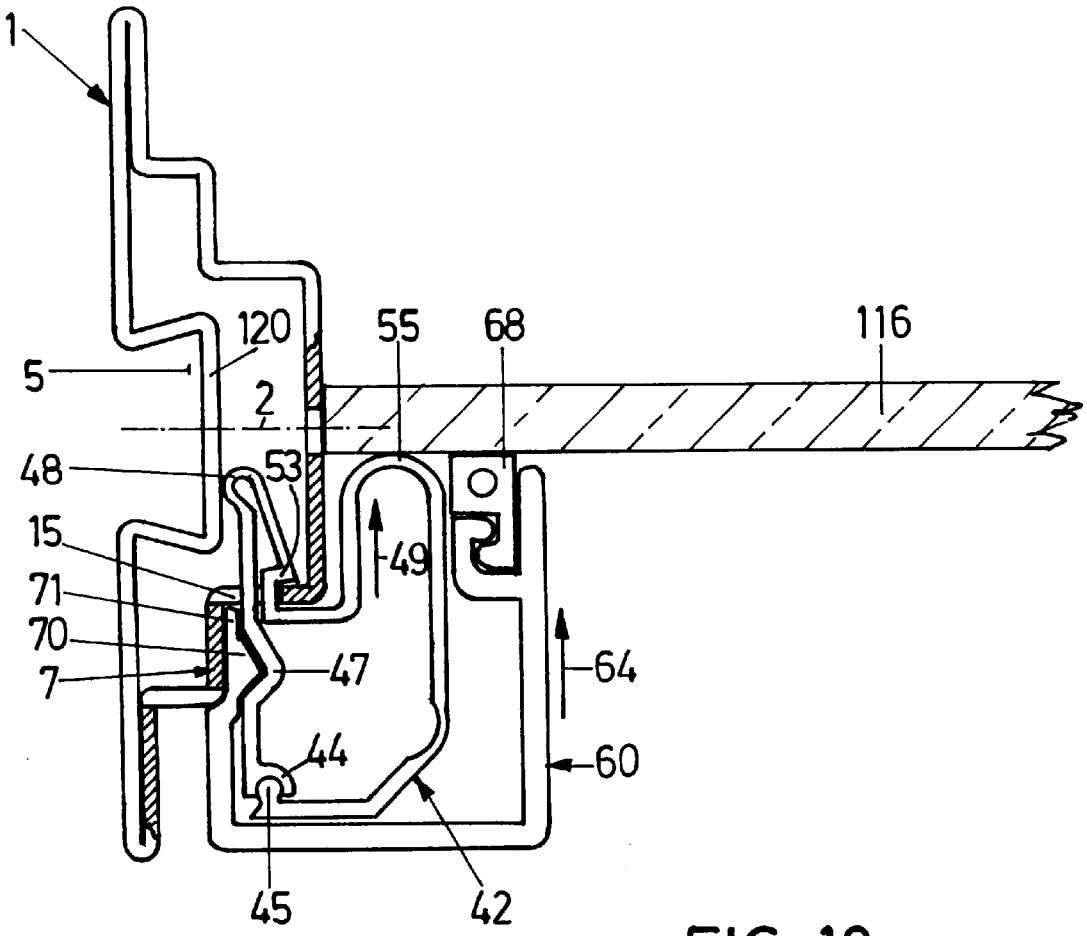
FIG. 18 is a partially cut lateral view of an arrangement in locking engagement of the support section of FIG. 2, of the fixing clamp of FIGS. 6 and 7 and of the capping of FIG. 8.

For the glass pane 116 to be fixed, the edge portion on both sides of the glass pane 116 is clamped from before and from behind by fixing clamps 42 substantially perpendicular to the longitudinal direction 3, FIG. 18 only illustrating the fixing by one fixing clamp 42. To this end, the supporting projection 48 is led through a forward snap-in hole 15 until the locking projection 53 snap-engages with the edge portion of the forward snap-in hole 15 so that the fixing clamp 42 is positively held in the direction of insertion 49. The supporting projection 48 supports itself on the base leg 120 of the outer groove 5, whereby the springy prestress of the supporting arc 55 relative to the glass pane 116 is effected. The supporting arc 55 supports itself by springy prestress on the glass pane 116. A fixing clamp 42 is locked into place in the forward snap-in hole 15 opposite to the forward snap-in hole 15 in the FIG. 18 relative to the central longitudinal plane 2.

Cables can be led through the inside of the fixing clamp 42, where they are retained. For them to be removed or to be fixed, the snap-in projection 45 is withdrawn from the groove 44, as a result of which the fixing clamp 42 opens as seen in FIG. 6.

After assembly of the fixing clamps 42 at positions of varying height of the glass pane 116 on the front and rear side thereof, cappings 60 are locked into place on the fixing clamps 42. To this end, one capping 60 at a time is slipped on the fixing clamp 42 parallel to the direction of insertion 64 and substantially perpendicular to the central longitudinal plane 2, whereby the wedged rib 70 snap-engages with the wedge-shaped groove 47 and the foredge 71 and shoulder 72 thereof are supported on the step 7. The sealing lip 68 rests flatly on the glass pane 116, it being avoided, when the glass pane 116 is cleaned, that liquid may enter the inside of the capping 60. The supporting projection 48 bearing against the base leg 120 ensures springy prestress between the wedge-shaped groove 47 and the wedged rib 70 so that the capping 60 is tightly engaged.

Figure 21:
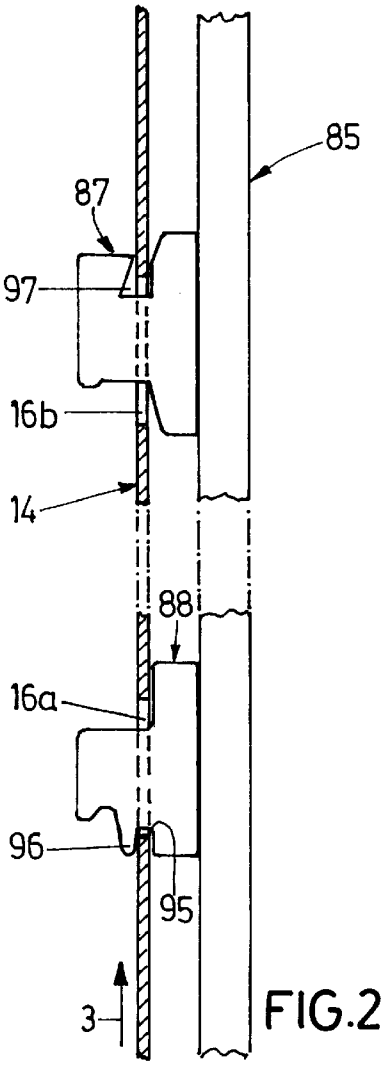
FIG. 21 is an illustration according to FIG. 20 in the final position.
Figure 20:
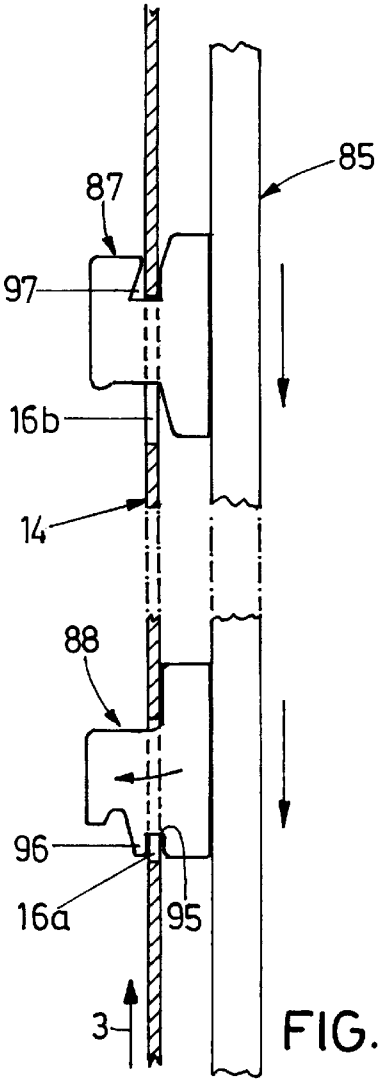
FIG. 20 is an illustration according to FIG. 19 in an intermediate position.
Figure 19:
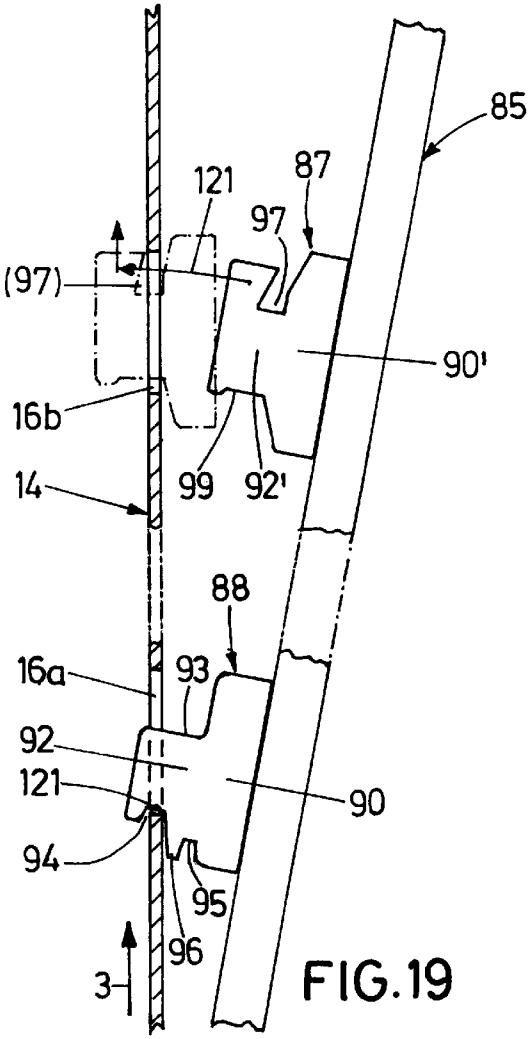
FIG. 19 is a diagrammatic illustration of the locking engagement of the hang-up panel of FIG. 13 in the support section of FIG. 1 in the initial position.

The following is a description of the mounting of the hang-up panel 85 on the support sections 1, taken in conjunction with FIGS. 19 to 21. At first, the hang-up panel 85 is hung up in two rearward snap-in holes 16*a* of identical height by the two lower panel mounts 88, which are provided on the lateral edges, so that the lower edge of the rearward snap-in holes 16*a* reaches into the respective first seat 94. This condition is seen in FIG. 19. Then the hang-up panel 85 is pivoted about the pivot axis 121 formed by the two first seats 94, the upper panel mounts 87 being led through corresponding rearward snap-in holes 16*b* until the edge portion thereof comes to rest on the base leg 90'. Then the hang-up panel 85 is displaced in the longitudinal direction 3 so that the upper edge portion of the hole 16*b*, which receives the panel mount 87, moves into the angle groove 97. Then the hang-up panel 85 is pivoted in the vicinity of the lower panel mount 88 so that the projection 96 is led entirely through the associated rearward snap-in hole 16*a* and the final seat 95 is in alignment with the rearward arrest line 14. This condition is seen in FIG. 20. Then the hang-up panel 85 is displaced against the longitudinal direction 3 so that the final seat 95 comes into engagement with the lower edge of the associated rearward snap-in hole 16*a*. In this position, the angle groove 97 accommodates the upper edge portion of the rearward snap-in hole 16*b* so that the hang-up panel 85, in the final position seen in FIG. 21, is supported downwards as well as maintained against tension substantially perpendicular to the longitudinal direction 3. The advantage of this kind of the mounting of the hang-up panel 85 resides in that the panel is not disengaged from, and cannot not fall out of, the rearward arrest line 14 even upon a motion of displacement in the longitudinal direction 3, but that it keeps being retained by the angle groove 97.

Figure 24:
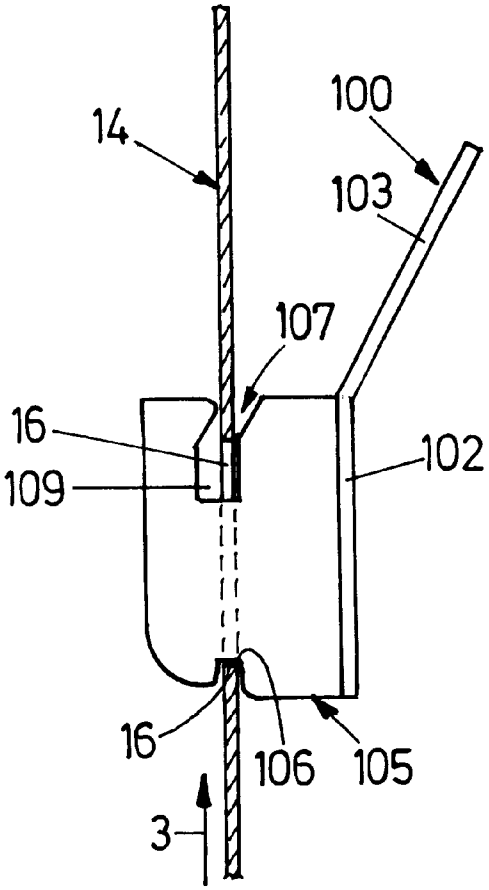
FIG. 24 is an illustration according to FIG. 23 in the final position.
Figure 23:
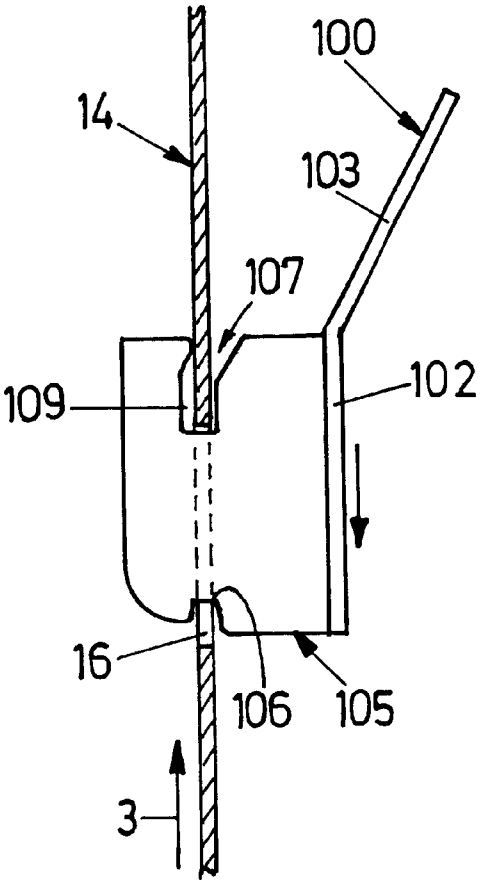
FIG. 23 is an illustration according to FIG. 22 in an intermediate position.
Figure 22:
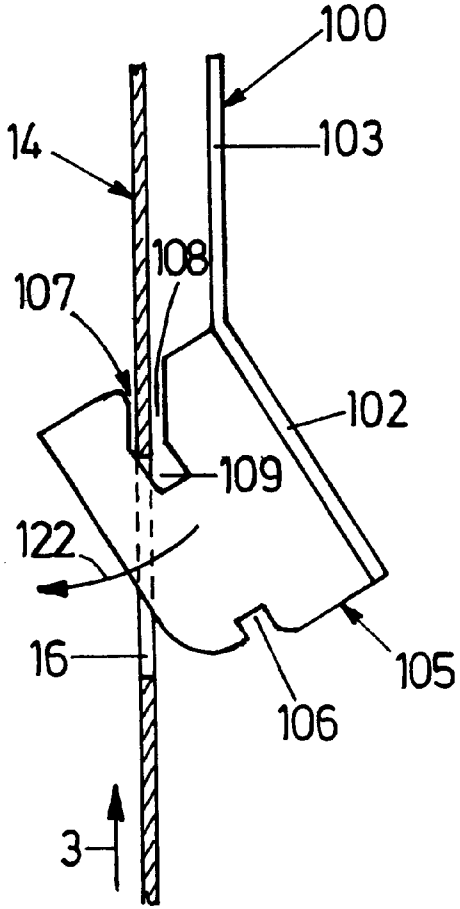
FIG. 22 is a diagrammatic illustration of the locking engagement of the ventilation facing board of FIG. 17 in the support section of FIG. 1 in the initial position.

The following is a description of the mounting of the ventilation facing board 100 on the support sections 1, taken in conjunction with FIGS. 22 to 24. The locking arms 105 on the ends are led from below in FIG. 22 into rearward snap-in holes 16 of identical height so that the upper edge thereof is introduced into the insertion slit 108. The ventilation facing board 100 is inserted in such a way that the ventilation board 103 is substantially parallel to the longitudinal direction 3. Then the facing board 100 is pivoted in the pivoting direction 122 until the snap-in seat 106 is in alignment with the rearward arrest line 14. In this case the upper edge of the rearward snap-in hole 16 moves into the base slit 109. This position is seen in FIG. 23. Then the facing board 100 is displaced against the longitudinal direction until the lower edge of the rearward snap-in hole 16 comes into engagement with the snap-in seat 106. This final position is seen in FIG. 24. In this position, the upper edge portion of the rearward snap-in hole 16 is still partially housed in the snap-in slit 107. The advantage of the locking mechanism corresponds to that of the hand-up panel 85.

Connecting the spacer 73 to the support section 1 takes place by insertion of the spacer 73 in the direction of insertion 76 into the outer groove 5, the jaws 75 engaging with the dove-tailed outer groove 5. The spacer 73 serves to keep the support section 1 at a distance from another neighboring support section 1 or from the columns of a supporting structure by means of the spring arms 77 which are then flexibly deformed. As a result, the support section 1, upon shock, does not hit directly against any neighboring elements.

As seen in FIG. 10, the cable clamp 78 is locked into place in a central snap-in hole 10 by the locking webs 83 being pushed through a central snap-in hole 10 until the locking projections 84 snap-engage with the surrounding of the central snap-in hole 10. The cable clamp 78 serves for the take-up and fixing of cables. These are inserted through the holes at the ends into the cable housing portions 82 and retained therein.

What is claimed is:

1. A partition wall arrangement (112), in particular for offices, comprising at least a support section (1) for the vertical support of the partition wall arrangement (112), the support section (1) having a longitudinal direction (3);

at least one arrest line (9, 13, 14), which extends in the longitudinal direction (3) and has snap-in holes (10, 15, 16) for the locking engagement of objects to be joined thereto;

a hook unit (119) comprising a first mounting hook (17) and a second mounting hook (18), the first mounting hook (17) and the second mounting hook (18) having at least a locking projection (22, 23) for snap-engagement with a snap-in hole (10, 15, 16);

the first mounting hook (17) and the second mounting hook (18) being joined to each other by a fastener (117, 118); and the first mounting hook (17) and the second mounting hook (18) having clamping noses (26, 26), which can be actuated by a force relative to each other by the fastener (117, 118); and a pane supporting board (29) for the horizontal accommodation and support of a pane (116), which possesses at least a holding groove (32; 40, 41) for the accommodation of a glass pane (116); and at least two clamping flutes (37, 38) for clamping and positive engagement with the clamping noses (26, 26').

2. A partition wall arrangement (112) according to claim 1, wherein a fixing clamp (42) is provided, comprising a locking arm unit which has a locking projection (53) for the insertion and locking engagement of the fixing clamp (42) in a snap-in hole (10, 15, 16) in a direction of insertion (49);

a supporting arc (55) or the support against the direction of insertion (49) of an object to be mounted.

3. A partition w arrangement (112) according to claims 2, wherein the fixing clamp (42) is a hollow section with a groove, it being possible to close the groove by a snap (43).

4. A partition wall arrangement (112) according to claim 2, wherein the fixing clamp (42) possesses a wedge-shaped groove (47) for the clamping connection of a capping (60), which has a wedged rib (70) for engagement with the wedge-shaped groove (47), between the wedge-shaped groove (47) and the support section (1).

5. A partition wall arrangement (112) according to claim 1, wherein a hang-up panel (85) is provided, having at least an upper panel mount (87) and a lower panel mount (88), the lower panel mount (88) comprising a first seat (94) for preliminary locking engagement with a snap-in hole (10, 15, 16), and a final seat (95) for final locking engagement with a snap-in hole (10, 15, 16); and the upper panel mount (87) comprising an angle groove (97) for locking engagement and pivoting of the hang-up panel (85) in a snap-in hole (10, 15, 16).

6. A partition wall arrangement (112) according to claim 1, wherein the support section (1) comprises an outer groove (5) for the locking engagement of a spacer (73).

7. A partition wall arrangement (112) according to claim 1, wherein a cable clamp (78) is provide for engagement in a snap-in hole (10, 15, 16), having cable housing portions (82) for the accommodation of cables.

8. A partition wall arrangement (112) according to claim 1, wherein at least a facing board (100, 101) is provided for engagement in a snap-in hole (10, 15, 16).

9. A kit for forming a partition wall arrangement (112) comprising:

at least one support section (1) for vertical support of the partition wall arrangement (112), the support section (1) having a longitudinal direction (3) and comprising at least one support wall (6, 11, 12) that extends along an arrest line (9, 13, 14) in the longitudinal direction (3) and has an array of snap-in holes (10, 15, 16);

a hook unit (119) comprising:

a first mounting hook (17) and a second mounting hook (18), the first mounting hook (17) and the second mounting hook (18) each having at least a locking projection (22, 23) for snap-engagement with a respective one of said snap-in holes (10, 15, 16), the first mounting hook (17) and the second mounting hook (18) having respective clamping noses (26, 26'); and a fastener (117, 118) adapted to join said first mounting hook (17) and second mounting hook (18) to each other while moving said clamping noses (26, 26') toward one another;

a pane supporting board (29) for the horizontal accommodation and support of a pane (116), said board having at least one holding groove (32; 40, 41) for supporting the pane, and at least two clamping flutes (37, 38) for clamping and positive engagement with the clamping noses (26, 26') of said hook unit;

a fixing clamp (42) comprising:

a locking arm unit which has a locking projection (53) for insertion of the fixing clamp (42) in an insertion direction in one of the snap-in holes (10, 15, 16) and locking engagement of the fixing clamp (42) in the one of the snap-in holes (10, 15, 16); and a supporting arc (55) for the support against the direction of insertion (49) of an object to be mounted; a hang-up panel (85) comprising:

a lower panel mount (88) having a first seat (94) for preliminary locking engagement with a first one of the snap-in holes (10, 15, 16), and a final seat (95) for final locking engagement with the first one of the snap-in holes (10, 15, 16); and an upper panel mount (87) having an angle groove (97) for locking and pivoting of the hang-up panel (85) in a second one of the snap-in holes (10, 15, 16) that is located above the first one of the snap-in holes (10, 15, 16);

a cable clamp (78) for engagement in a snap-in hole (10, 15, 16), having cable housing portions (82) accommodating cables; and a facing board (100, 101) for engagement in one of the snap-in holes (10, 15, 16).

10. The partition wall arrangement of claim 1 wherein said clamping flutes are clamped between said clamping noses when said pane supporting board is assembled to said hook unit.

* * * * *